US006036165A

United States Patent [19]

Lee

[11] Patent Number: 6,036,165

[45] Date of Patent: Mar. 14, 2000

[54] METHOD AND APPARATUS FOR CONSTRUCTING A BUILDING UNIT

[76] Inventor: Kou-An Lee, No. 851, Chung-Shan Rd., Nan-Shing Tsun, Kui-Jen Hsiang, Tainan Hsien, Taiwan

[21] Appl. No.: 09/089,240

[22] Filed: Jun. 2, 1998

[51] Int. Cl.[7] ..... E04G 11/00

[52] U.S. Cl. ..... 249/19; 249/20; 249/26

[58] Field of Search ..... 52/745.09, 745.06; 264/34, 33; 249/20, 19, 27, 26, 21

[56] References Cited

U.S. PATENT DOCUMENTS

| | | | |
|---|---|---|---|
| 954,165 | 4/1910 | Brussel | 249/19 X |
| 2,222,339 | 11/1940 | Schenk . | |
| 3,504,879 | 4/1970 | Strickland | 264/33 |
| 3,690,613 | 9/1972 | Shoemaker . | |
| 3,993,720 | 11/1976 | Burdett | 249/20 X |
| 4,254,932 | 3/1981 | Durbin . | |
| 4,667,923 | 5/1987 | Lee | 249/19 |
| 4,679,762 | 7/1987 | Lee | 249/27 X |
| 4,717,517 | 1/1988 | Halbestadt | 264/33 |
| 4,778,144 | 10/1988 | Gregory | 264/33 X |
| 5,263,835 | 11/1993 | Schmidt | 249/20 X |
| 5,282,603 | 2/1994 | Taraldsson . | |
| 5,490,367 | 2/1996 | Lee | 249/20 X |
| 5,492,303 | 2/1996 | Jaruzel . | |
| 5,528,877 | 6/1996 | Franklin | 52/745.2 X |
| 5,762,815 | 6/1998 | Lee . | |

*Primary Examiner*—Carl D. Friedman
*Assistant Examiner*—Brian E. Glessner
*Attorney, Agent, or Firm*—Baker Botts L.L.P.

[57] ABSTRACT

A method for constructing an upper concrete building unit on top of a pre-formed lower concrete building unit includes: (a) mounting vertical positioning pegs on the lower building unit; (b) disposing a horizontal floor form panel on top of the lower building unit, and providing holes in the floor form panel for passage of the positioning pegs to project upward through the floor form panel; (c) pouring concrete onto the floor form panel to form a concrete floor structure of the upper building unit with the positioning pegs projecting outwardly and upwardly therefrom; (d) mounting an upright wall form assembly on portions of the positioning pegs which project from the concrete floor structure of the upper building unit; and (e) pouring concrete into the wall form assembly to form a concrete wall structure of the upper building unit.

4 Claims, 8 Drawing Sheets

METHOD AND APPARATUS FOR CONSTRUCTING A BUILDING UNIT

BACKGROUND OF THE INVENTION

1. Field of the Invention

This invention relates to a method and an apparatus for constructing a building unit, more particularly to a method and apparatus for constructing an upper building unit on top of a pre-formed lower building unit by providing positioning pegs on the lower building unit so that the positioning pegs project upwardly from the concrete floor structure of the upper building unit when the latter is formed, and by mounting a wall form assembly on the projecting portions of the positioning pegs for forming the wall structure of the upper building unit without the need for waiting for a long period of time to allow hardening of the concrete floor structure of the upper building unit, thereby shortening the working period of the forming operation.

2. Description of the Related Art

In recent years, conventional forming operations for constructing concrete structures by nailing together wooden panels and pouring concrete between the wooden panels have been replaced by forming operations using modular steel form assemblies which permit efficient and high-quality construction of concrete structures and which result in savings in labor costs.

Conventionally, a building structure having a plurality of layers of building units, each of which includes a horizontal floor structure and at least one upright wall structure, is constructed in sequence by forming an upper building unit on top of upright wall structures of a lower building unit after the lower concrete building unit has hardened. Referring to FIGS. 1 and 2, a conventional modular form assembly 1 is shown to include a plurality of horizontal transverse and longitudinal girders 10, 11, a horizontal floor form panel 12 disposed on top of the girders 11, 10, and an upright wall form assembly 13. During construction of the concrete building units of the building structure, the modular form assembly 1 for an upper building unit is disposed on top of the upright concrete wall structures 15 of a lower building unit after the concrete wall structures 15 and the floor structure 14 of the lower building unit have hardened. In operation, positioning seats 16 are fastened to upper end portions of the concrete wall structures 15 and are spaced apart from one another. The transverse and longitudinal girders 10, 11 are mounted on the positioning seats 16. Then, the floor form panel 12 is disposed on top of the girders 11, 10, and the associated reinforcing bars and plumbing members are installed on the floor form panel 12. Thereafter, concrete is poured onto the floor form panel 12 and is allowed to harden after a waiting period of about 18 to 36 hours to form a concrete floor structure 17 with a sufficient strength. After the concrete floor structure 17 has hardened, an inner mold of the wall form assembly 13 is disposed on the concrete floor structure 17 at a predetermined position, and an outer mold is disposed around the inner mold and the floor structure 17 to confine a concrete pouring space. Associated reinforcing bars and plumbing members are installed on the wall form assembly 13 within the concrete pouring space before concrete is poured into the latter to form the wall structure. After waiting for another period of time to allow hardening of the concrete wall structure, the above procedures are repeated for constructing a further upper one of the building units.

Therefore, during construction of the building structure, a relatively long period of waiting time is needed to allow each of the floor structures and the wall structures to harden so as to impart sufficient strength to the same. The working period is generally overly long and cannot be shortened. This problem becomes more severe when constructing a building structure which has identical building units at different sites. Due to the insufficient space in the work place of the building structure, a single formwork is usually employed at different sites in an alternate manner for constructing the building units. This is achieved by advancing the operating procedure in a site (A) to the operating procedure in another site (B) for a work stage. That is, when the concrete wall structure formed in the site (A) has hardened, the wall form assembly is detached therefrom for use in the site (B) for constructing the same concrete wall structure therein. However, that the wall form assembly used in the site (A) cannot be detached until the concrete floor structure formed in the site (B) has hardened, which usually takes a long period of time. As such, a relatively large part of the working period is spent waiting for the concrete floor structures to harden during the construction of the building units.

SUMMARY OF THE INVENTION

A first object of the present invention is to provide a method for constructing an upper building unit on top of a pre-formed lower building unit in a faster manner by obviating the need to wait for a long period of time to allow the formed concrete floor structure to harden.

A second object of the present invention is to provide an apparatus used in the method of the present invention for constructing an upper building unit on top of a pre-formed lower building unit.

According to a first aspect of the present invention, there is provided a method for constructing an upper concrete building unit on top of a pre-formed lower concrete building unit. Each of the building units includes a horizontal concrete floor structure and at least one upright concrete wall structure extending upwardly from the floor structure. The method includes: (a) mounting vertical positioning pegs on the lower building unit; (b) disposing a horizontal floor form panel on top of the lower building unit, and providing holes in the floor form panel for passage of the positioning pegs to project upward through the floor form panel; (c) pouring concrete onto the floor form panel to form the concrete floor structure of the upper building unit with the positioning pegs projecting outwardly and upwardly therefrom; (d) mounting an upright wall form assembly on portions of the positioning pegs which project from the concrete floor structure of the upper building unit; and (e) pouring concrete into the wall form assembly to form the concrete wall structure of the upper building unit.

According to a second aspect of the present invention, there is provided an apparatus for constructing an upper building unit on top of a pre-formed lower building unit. Each of the building units includes a horizontal concrete floor structure and at least one upright concrete wall structure extending upwardly from the concrete floor structure. The apparatus includes positioning pegs adapted to be mounted on the lower building unit, a horizontal floor form panel adapted to be disposed on top of the lower building unit for forming the concrete floor structure of the upper building unit, the floor form panel having holes for passage of the positioning pegs so that the positioning pegs project upward through the floor form panel, and an upright wall form assembly to be mounted on the positioning pegs at a level above and with a spacing from the floor form panel for forming a concrete wall structure on the concrete floor structure of the upper building unit.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
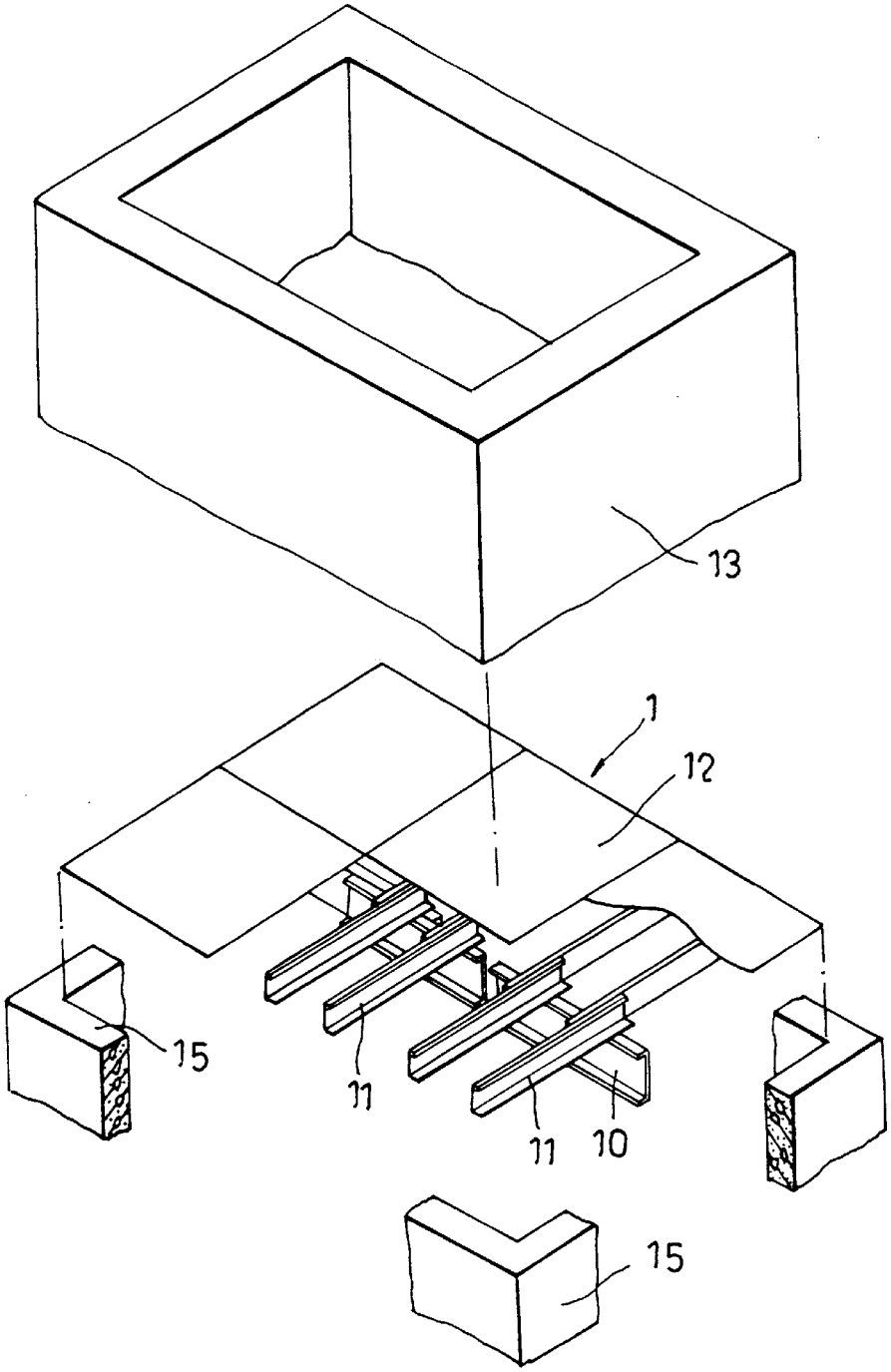
FIG.1 PRIOR ART
FIG. 1 is a perspective schematic view illustrating a conventional modular form assembly for constructing a building unit.
Figure 2:
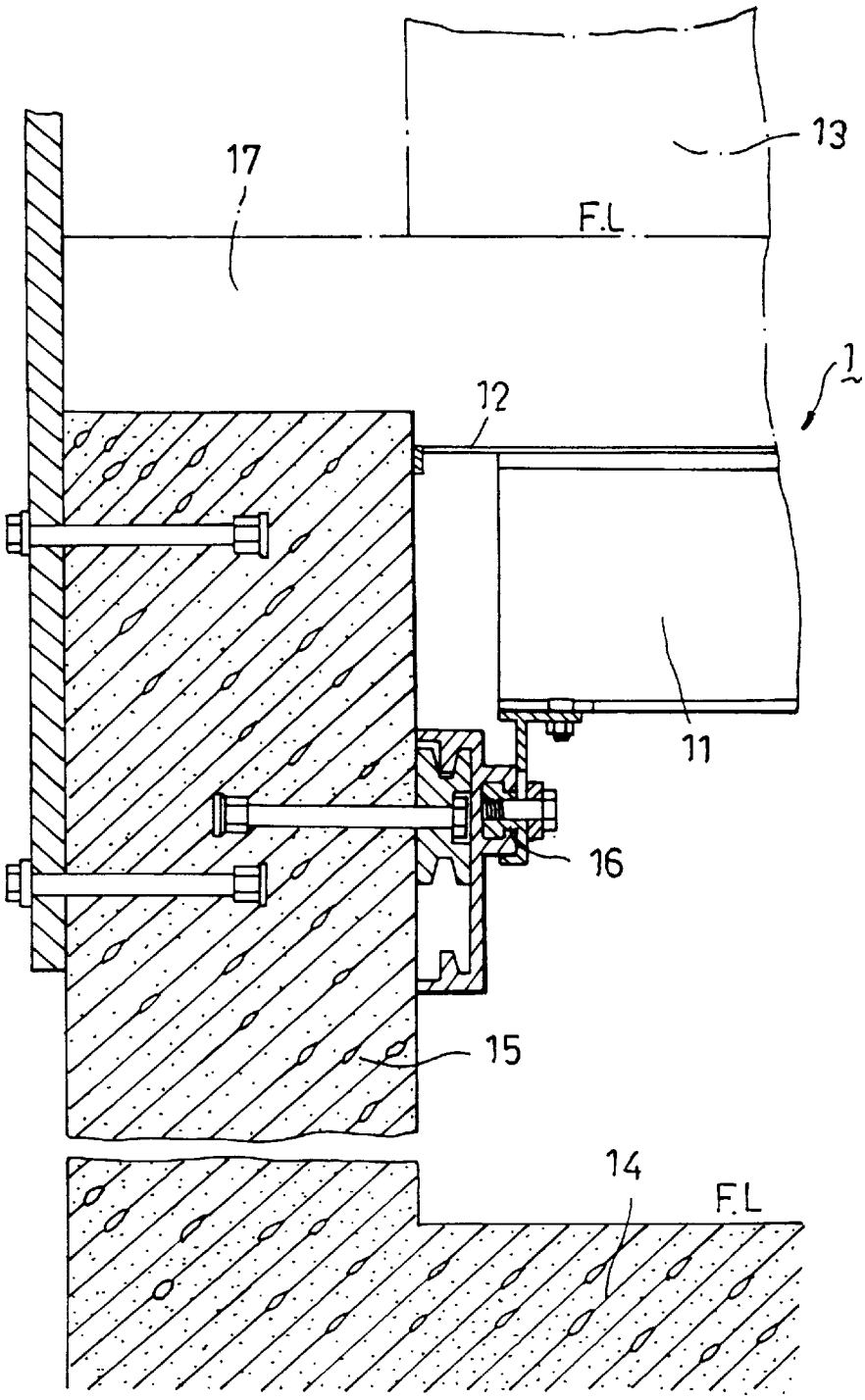
FIG.2 PRIOR ART
FIG. 2 is a vertical sectional view illustrating the construction of the building unit in a conventional method using the conventional modular form assembly.
Figure 3:
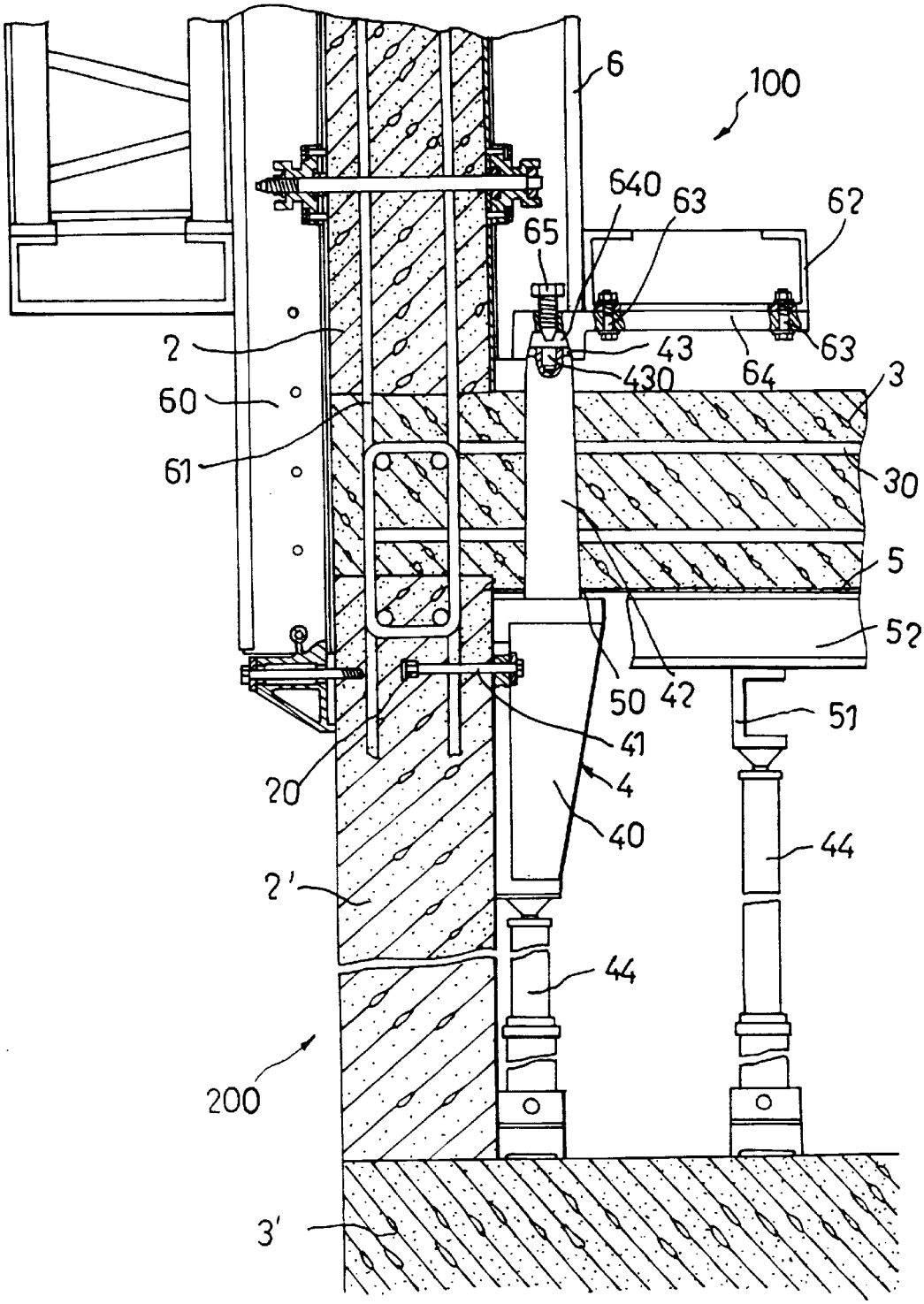
FIG. 3 is a vertical sectional view illustrating the construction of an upper building unit on top of a pre-formed lower building unit via a first preferred embodiment of the present invention.
Figure 6:
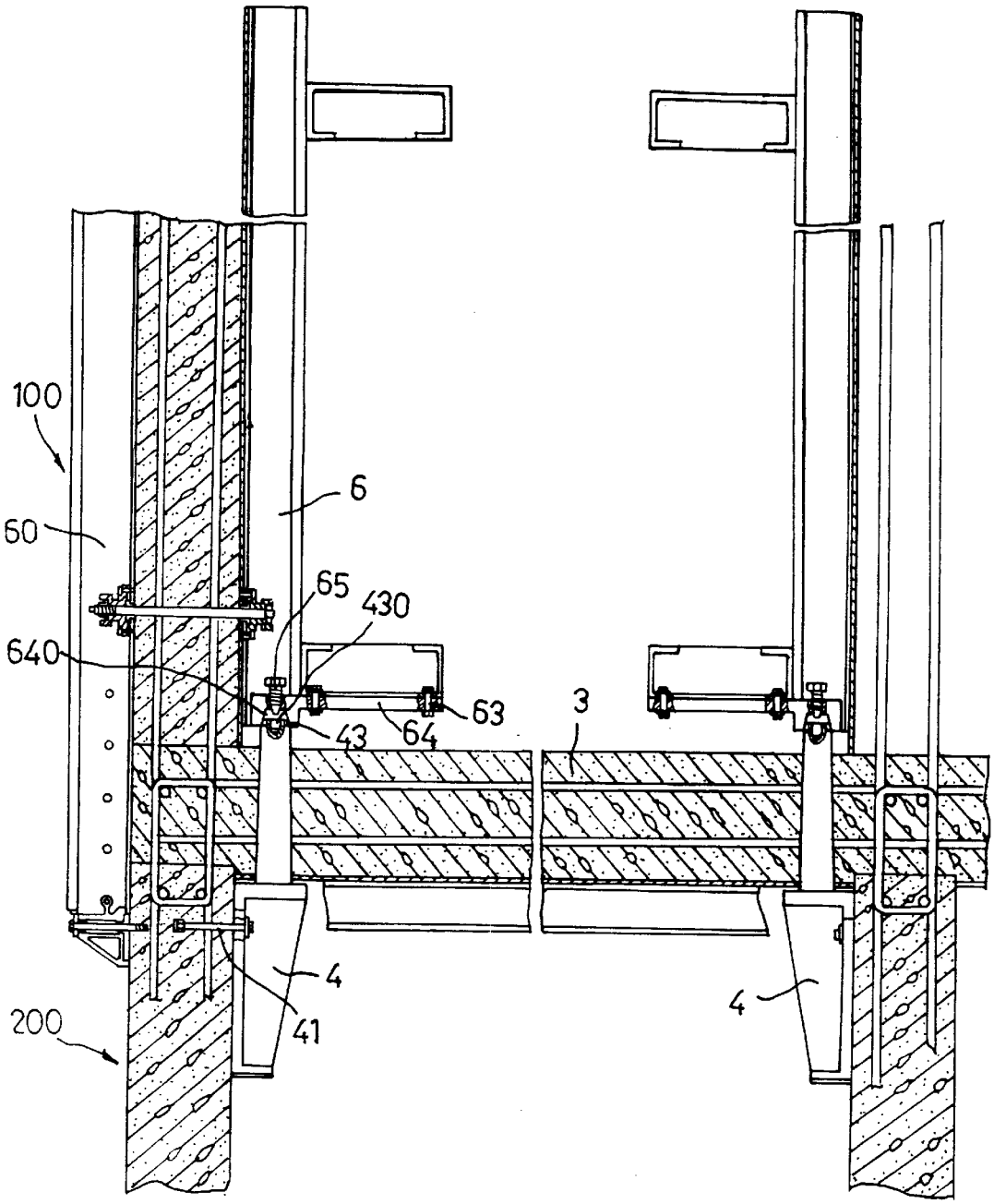

The method and the apparatus of the present invention are used for constructing an upper concrete building unit on top of a pre-formed lower concrete building unit. Each concrete building unit includes a horizontal concrete floor structure and at least one upright concrete wall structure extending upwardly from the concrete floor structure to interconnect floor structures of adjacent upper and lower building units. Referring to FIGS. 3 and 6, the first preferred embodiment of the apparatus of the present invention is shown to include a plurality of positioning pegs 4, a horizontal floor form panel 5, and an upright wall form assembly 6.

The positioning pegs 4 are formed as upright elongated rods and are disposed adjacent to wall structures 2' of a lower pre-formed building unit 200. Each of the positioning pegs 4 has a lower section 40 formed as a fastening seat portion which is fastened to a pre-embedded nut 20 in the adjacent wall structure 2' of the lower building unit 200 by means of a screw bolt 41, and an upper section 42 formed as a peg portion which extends upwardly from the lower section 40 for a sufficient length so as to project from the concrete floor structure 3 of the upper building unit 100 to be formed. Each of the positioning pegs 4 has a tapered top end 43 formed with a positioning hole 430.

The floor form panel 5 is disposed horizontally on top of the wall structures 2' of the lower building unit 200, and is formed with holes 50 for passage of the upper sections 42 of the positioning pegs 4 therethrough so as to project the upper sections 42 of the positioning pegs 4 from the floor form panel 5. A sufficient number of transverse and longitudinal girders 51, 52 are mounted below the floor form panel 5 to help support the floor form panel 5.

The wall form assembly 6 is used as an inner form assembly for forming an upright concrete wall. The wall form assembly 6 is mounted on top of the positioning pegs 4 at a level above and is spaced from the floor structure 3 formed on the floor form panel 5. The wall form assembly 6 has a bottom end provided with a rail member 62 at an inner side thereof. The rail member 62 is fastened to a positioning plate 64 disposed on a bottom side of the rail member 62 by means of screw members 63. The positioning plate 64 has an end portion disposed adjacent to the bottom end of the wall form assembly 6 and formed with a conical-shaped coupling hole 640 aligned with the positioning hole 430 of a respective one of the positioning pegs 4. A positioning bolt 65 extends threadedly through the coupling hole 640 and into an aligned one of the positioning holes 430 to mount the wall form assembly 6 on the positioning peg 4.

Figure 4:
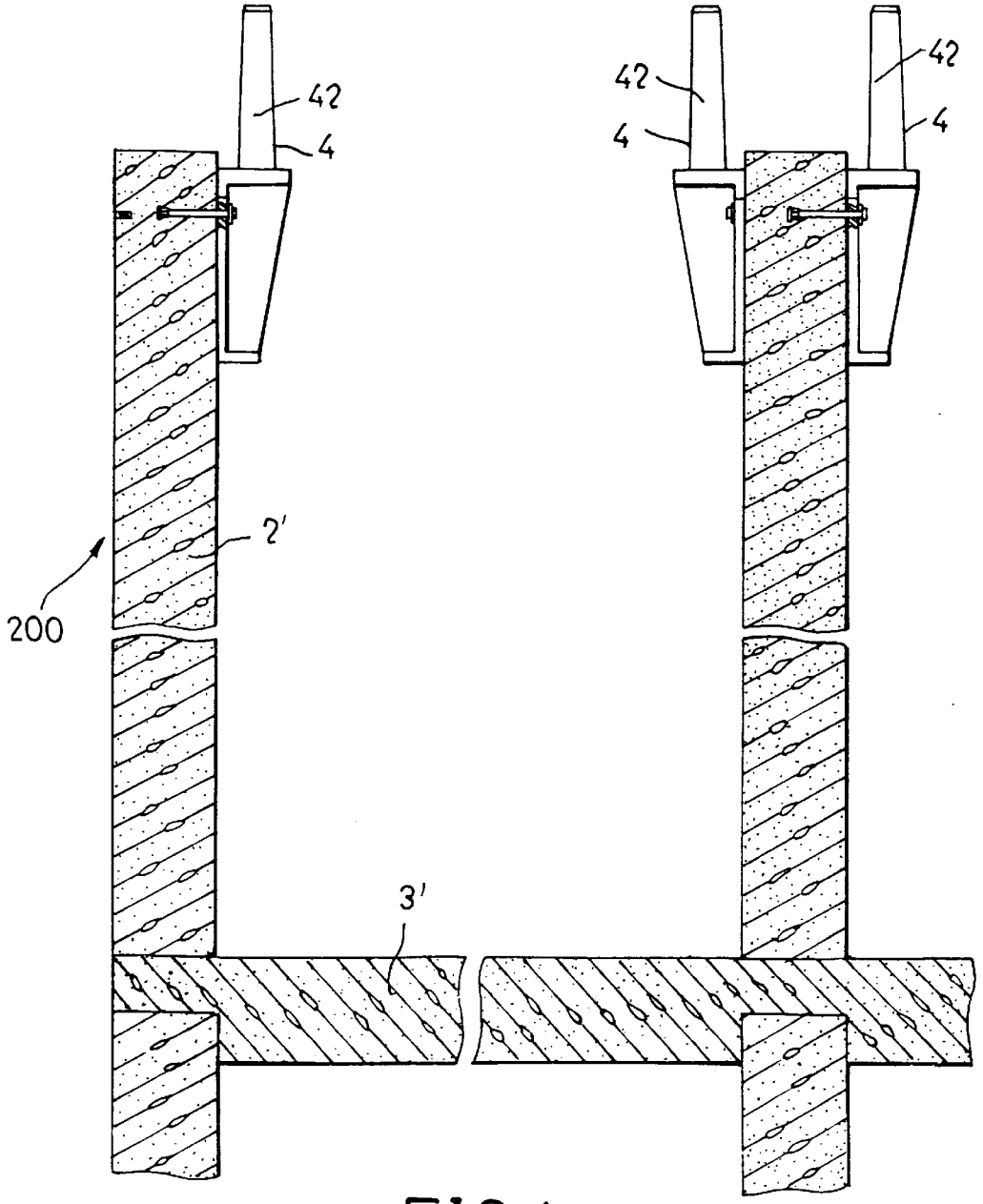
FIGS. 4 to 6 illustrate the method of the first preferred embodiment.
Figure 5:
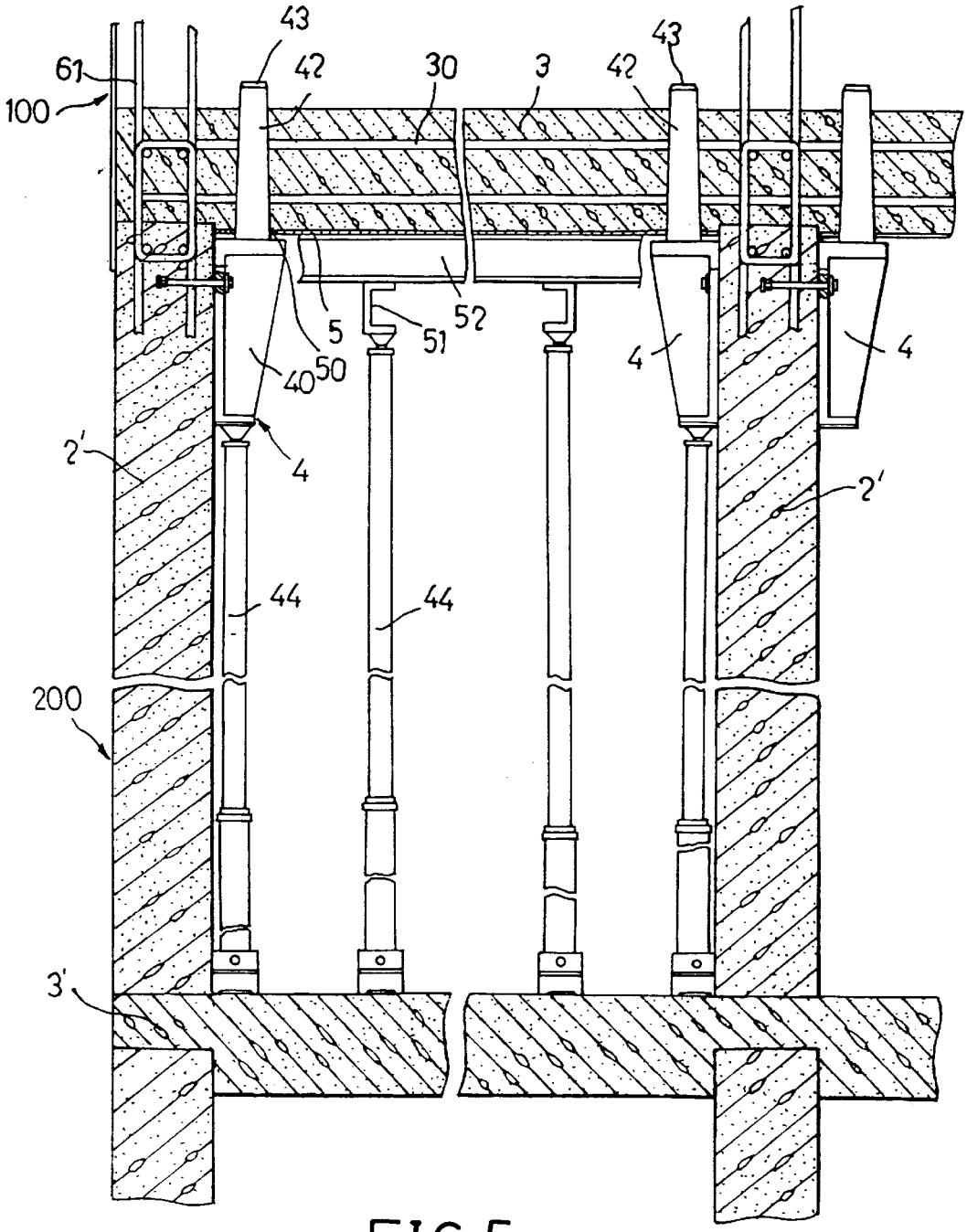

Referring to FIGS. 4 to 6, the first preferred embodiment of the method of the present invention is conducted in the following manner:

According to the required strength for supporting the upper concrete building unit 100 to be formed, a sufficient number of positioning pegs 4 are fastened to the wall structures 2' of the pre-formed lower building unit 200 at the same level. In the present embodiment, four positioning pegs 4 are sufficient to support four corners of the wall form assembly 6. As shown in FIG. 4, the upper sections 42 of the positioning pegs 4 are allowed to project upwardly relative to the wall structures 2' of the lower building unit 200 for a length sufficient to project upwardly from the concrete floor structure 3 of the upper building unit 100 to be formed.

As shown in FIG. 5, the transverse girders 51 and the longitudinal girders 52 (only one is shown) are mounted among the concrete wall structures 2'. Connecting members (not shown) are provided to connect the girders 51, 52. The floor form panel 5 is disposed on top of the wall structures 2' and the girders 51, 52 to allow extension of the upper sections 42 of the positioning pegs 4 through the floor form panel 5 via the holes 50. If necessary, a plurality of longer and shorter struts 44 can be provided on the floor structure 3' to support the lower sections 40 of the positioning pegs 4 and the transverse girders 51.

The floor form panel 5 is installed with floor reinforcing bars 30, wall reinforcing bars 61 and plumbing members. Thereafter, concrete is poured onto the floor form panel 5 to form the concrete floor structure 3 with the top ends 43 of the positioning pegs 4 projecting outwardly and upwardly from the concrete floor structure 3.

Immediately after pouring of concrete, or after the initial hardening of concrete (about 1 to 1.5 hour after pouring), the wall form assembly 6 is brought above the concrete floor structure 3 to rest on the top ends 43 of the positioning pegs 4 with the screw members 63 in a loosened state to permit adjustment of the position of the positioning plates 64 in a horizontal direction. The coupling holes 640 of the positioning plates 64 are aligned respectively with the positioning holes 430 in the top ends 43 of the positioning pegs 4. Then, the positioning bolts 65 are extended downwardly and respectively through the coupling holes 640 and into the aligned positioning holes 430 in order to mount the wall form assembly 6 to the positioning pegs 4. The screw members 63 are subsequently tightened to fasten the positioning plates 64 to the wall form assembly 6. Thereafter, outer forms 60 are disposed around the floor structure 3 and the wall form assembly 6 to confine a concrete pouring space with the wall form assembly 6. Concrete is poured into the concrete pouring space to form the concrete wall structure 2.

After the concrete wall structure 2 has hardened to have an initial strength, the positioning bolts 65 are operated for removal from the positioning holes 430 of the positioning pegs 4, and the wall form assembly 6 is detached from the concrete wall structure 2.

After the concrete floor structure 3 and the concrete wall structure 2 of the upper building unit 100 have hardened, the struts 44, the girders 51, 52 and the floor form panel 5 can be detached, and the screw bolts 41 are unthreaded for removal from the wall structure 2' of the lower building unit 200. Thereafter, the positioning pegs 4 are forced downwardly for removal from the concrete floor structure 3 by hammering the top ends 43 of the positioning pegs 4 downwardly, thereby leaving cavities in the concrete floor structure 3. The bottom openings of the cavities are covered by means of the struts 44, and concrete is poured into the cavities to fill the same.

The apparatus and the method of the present embodiment provides the following advantages:

1) The working period is shortened. Since the positioning pegs 4 which support and position the wall form assembly 6 are secured to the wall structures 2' of the pre-formed lower building unit 200, there is no need to wait for a long period of time to allow the concrete floor structure 3 to harden before erection of the wall form assembly 6 and formation of the concrete wall structure 2. The working period can be substantially shortened.

2) The positioning pegs 4 are mounted on the wall structure 2' of the lower building unit 200 at predetermined positions, and the wall form assembly 6 is directly brought to be mounted on the projecting top ends 43 of the positioning pegs 4. As such, a preliminary marking operation for indicating the precise position of the wall form assembly 6 can be obviated. It is not necessary to move the entire wall form assembly 6 along the floor structure 3 for adjusting the position thereof. The forming operation can be conducted in a simplified manner.

In constructing a building structure having identical building units at different sites, for example, (C) and (D), via the apparatus and method of the present embodiment, after pouring of concrete to form the concrete wall structure in the site (C), the wall form assembly used in the site (C) can be detached for used in the site (D) immediately after pouring of concrete onto the floor form panel in the site (D), without the need for waiting for a long period of time to allow both the concrete wall structure in the site (C) and the concrete floor structure in the site (D) to harden. The shortening of the working period is more significant in this situation.

Figure 7:
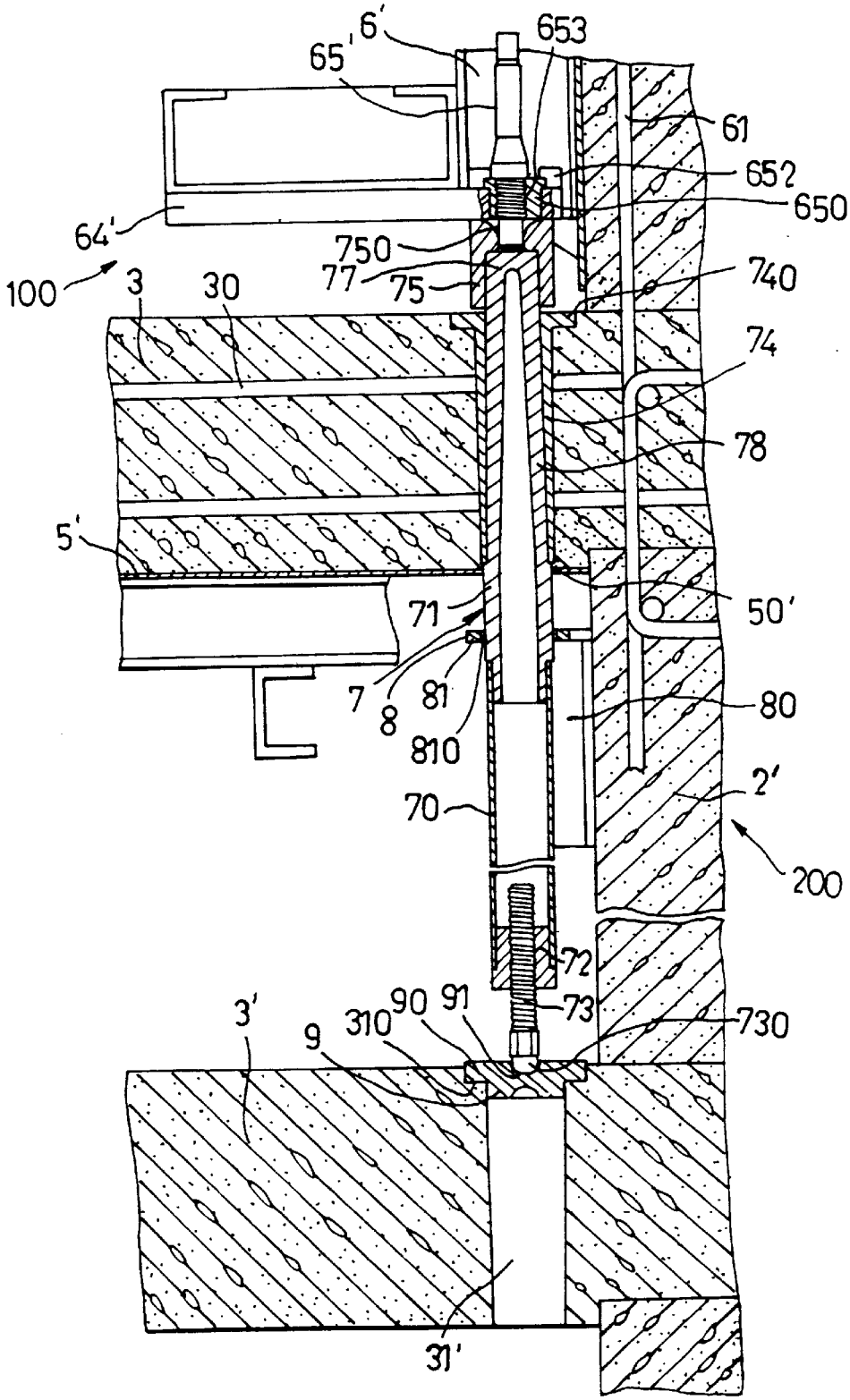
FIG. 7 is a vertical sectional view illustrating the construction of an upper building unit on top of a pre-formed lower building unit via a second preferred embodiment of the present invention.

Referring to FIG. 7, the apparatus of the second preferred embodiment according to the present invention is shown to also include positioning pegs 7, a horizontal floor form panel 5', an upright wall form assembly 6', and struts 70 for supporting the positioning pegs 7.

Each of the positioning pegs 7 has a lower section 71 disposed below the floor form panel 5', and an upper section 78 which tapers upwardly and which extends upwardly from the floor form panel 5' via the holes 50' and which has a length sufficient to project upwardly and outwardly from the concrete floor structure 3 to be formed. A packing member 75 is sleeved on a top end 77 of a respective one of the positioning pegs 7 that projects from the formed concrete floor structure 3, and is formed with a conical-shaped positioning hole 750 which diverges upwardly.

A guiding sleeve 74 is sleeve around the tapered upper section 78 of a respective one of the positioning pegs 7 below the packing member 75. The guiding sleeve 74 has an upwardly converging inner surface in contact with the tapered upper section 78 of the positioning peg 7, an upwardly diverging outer surface, and a horizontal top flange 740. The guiding sleeve 74 has a length substantially equal to the thickness of the concrete floor structure to be formed on the floor form panel 5'.

The horizontal floor form panel 5' has a structure similar to that in the previous embodiment. The floor form panel 5' is disposed between the upper and lower sections 78, 71 of the positioning pegs 7, and is formed with holes 50' to permit passage of the positioning pegs 7.

Each of the struts 70 has an upper end mounted threadedly to the lower section 71 of a respective one of the positioning pegs 7, and is provided with an internally threaded female member 72 and a bolt 73 that engages the female member 72 and that has a strength sufficient to support the positioning peg 7. The bolt 73 has a rounded bottom end adapted to abut against the concrete floor structure 3' of the pre-formed lower building unit 200. Brackets 8 are secured to the wall structures 2' of the lower building unit for retaining the positioning pegs 7. Each of the brackets 8 has a horizontal plate portion 81 formed with a hole 810 to permit passage of the lower section 71 of the respective positioning peg 7 above the strut 70, and an L-shaped angle member 80 abutting against and mounted threadedly to the adjacent wall structure 2' of the lower building unit 200. Alternatively, the angle member 80 may be configured as a straight flat plate for securing to a flat portion of the wall structure 2'.

Below each of the struts 70, there is provided a support plate 9 for supporting the respective strut 70. The support plate 9 fills an open upper end of a cavity 31' formed in the floor structure 3' of the lower building unit 200 upon removal of the positioning pegs 7 and the guiding sleeves 74 from the floor structure 3' of the lower building unit 200 in a previous forming operation for forming the lower building unit 200. The support plate 9 has a flange portion 90 with a diameter corresponding to that of the top flange 740 of the guiding sleeve 74 and abutting against an L-shaped abutment portion 310 which is formed adjacent to the cavity 31' by the top flange 740 of the guiding sleeve 74. The support plate 9 has top and bottom sides formed with opposite recesses 91 for supporting and receiving the rounded bottom end of the bolt 73 of the strut 70.

The wall form assembly 6' is also provided with a positioning plate 64' at a bottom side thereof. The positioning plate 64' is provided with an eccentric nut 650 having an eccentric threaded hole 653. A bolt 65' extends through the eccentric positioning hole 653 of the nut 650 and into the conical-shaped positioning hole 750 for mounting the wall form assembly 6' to the respective positioning peg 7. The bolt 65' is operable to move the eccentric nut 650 and the positioning plate 64' together with the eccentric nut 650, thereby permitting adjustment of the position of the wall form assembly 6' within a limited range. A retaining member 652 is provided on a top side of the nut 650 for retaining the nut 650 in the positioning plate 64'.

The second preferred embodiment of the method of the present invention is conducted in the following manner:

According to the strength required, a number of brackets 8 are secured to the wall structures 2' of the pre-formed lower building unit 200 at the same level. The positioning pegs 7 are extended through the holes 810 in the brackets 8, respectively, from a bottom side thereof, and are raised to be spaced from the floor structure 3' of the lower building unit 200 so as to permit placing of the support plates 9 on the open top ends of the cavities 31' such that the flanges 90 of the support plates 9 rest on the abutment portions 310 of the floor structure 3'. In the case that the lower building unit is the ground floor of the building structure, the support plate 9 is inverted to contact the original top side with the surface of the ground floor (not shown). The positioning pegs 7 and the struts 70 mounted thereon are then lowered so that the rounded bottom ends 730 of the struts 70 abut against the support plates 90 in the recesses 91. Alternatively, the support plates 9 can be disposed on the floor structure 3' of the lower building unit 200 before mounting the positioning pegs 7 and the struts 70.

Figure 8:
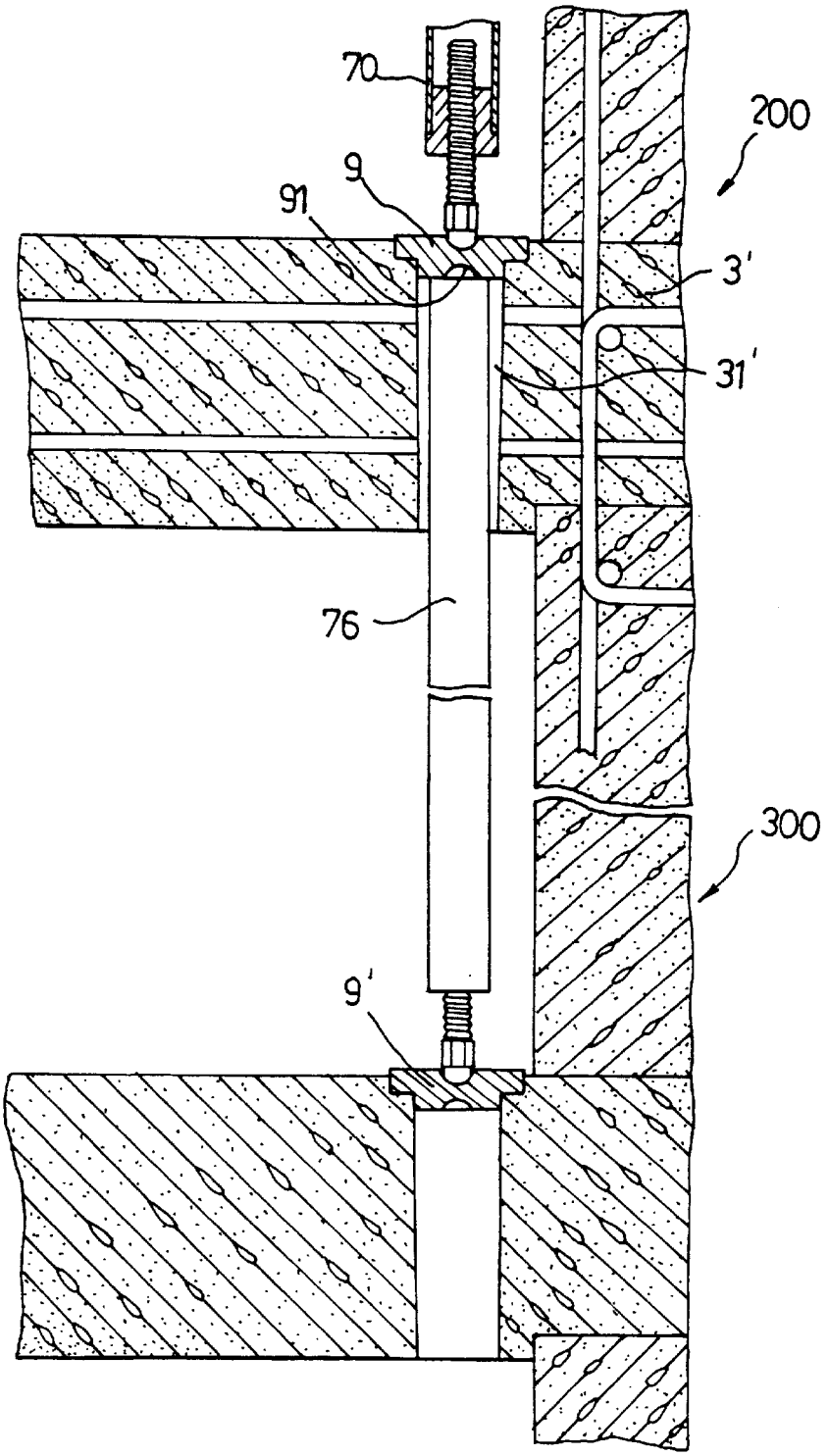
FIG. 8 is another vertical sectional view illustrating a strut for supporting an apparatus used in the second preferred embodiment on the pre-formed lower building unit.

As with the previous embodiment, a plurality of transverse and longitudinal girders are mounted among the concrete wall structures 2', and the floor form panel 5' is disposed on top of the wall structures 2' and the girders to permit extension of the upper sections 78 of the positioning pegs 7 through the floor form panel 5' via the holes 50'. The guiding sleeves 74 are sleeved around the upper sections 78 of the positioning pegs 7. Referring to FIG. 8, if necessary, a plurality of struts 76 are provided between the support plates 9 and a floor structure of a further lower building unit 300 which is located below the lower building unit 200. Each of the struts 76 has a top end abutting against the bottom side of the support plate 9, and a bottom end abutting against a top side of a support plate 9' that is disposed on the floor structure of the lower building unit 300. In this manner, the floor structure 3 to be formed can be supported stably on the floor structures of the two lower building units 200, 300. Apparently, struts may also be provided between the girders and the floor structure 3' of the lower building unit 200, if necessary.

The floor form panel 5' is installed with floor reinforcing bars 30, wall reinforcing bars 61 and plumbing members. Thereafter, concrete is poured onto the floor form panel 5' to form the concrete floor structure 3 with the top ends 77 of the positioning pegs 7 projecting outwardly and upwardly from the concrete floor structure 3 and with the guiding sleeves 74 embedded within the concrete floor structure 3.

Immediately after pouring of concrete, or after the concrete is initially hardened (about 1 to 1.5 hour after pouring), the packing members 75 are sleeved on the projecting top ends 77 of the positioning pegs 7. The wall form assembly 6' is brought above the concrete floor structure 3 to be disposed on top of the packing members 75 so as to align the eccentric threaded holes 653 of the eccentric nuts 650 with the conical-shaped positioning holes 750, respectively. Then, the bolts 65' are extended downwardly and respectively through the eccentric threaded holes 650 to engage the same, and are inserted into the conical-shaped positioning holes 750 in order to mount and position the wall form assembly 6' on the positioning pegs 7. After outer forms (not shown) are erected in a usual way, concrete is poured to form the concrete wall structure 2.

In detaching the pegs 7, the bolts 73 of the struts 70 disposed below the positioning pegs 7 are turned to move the positioning pegs 7 upwardly away from the support plates 9, thereby pushing upwardly and separating the guiding sleeves 74 from the formed concrete floor structure 3. The guiding sleeves 74 can thus be removed manually or by means of a tool from the concrete floor structure 3 to separate from the positioning pegs 7. Thereafter, the positioning pegs 7 and the struts 70 mounted thereon are pulled upwardly into the upper building unit 100 for removal from the concrete floor structure 3, thereby leaving cavities 31 in the concrete floor structure 3. The struts 76 disposed in the building unit 300 below the struts 70 may also be pulled upwardly via the cavities 31' after the support plates 9 are removed from the floor structure 3' of the lower building unit 200.

It has thus been shown that, in the present embodiment, the positioning pegs 7 and the struts 70, which are large in size and weight and are thus inconvenient to transport, can be directly pulled upwardly into the upper building unit 100. Only the brackets 8 and the supports plates 9 which are smaller in size and weight need to be transported. This simplifies the forming operation.

With this invention thus explained, it is apparent that numerous modifications and variations can be made without departing from the scope and spirit of this invention. It is therefore intended that this invention be limited only as indicated in the appended claims.

I claim:

1. An apparatus for constructing an upper building unit on top of a pre-formed lower building unit, each of the building units including a horizontal concrete floor structure and at least one upright concrete wall structure extending upwardly form the concrete floor structure, said apparatus comprising:

a horizontal floor form panel adapted to be disposed on top of the lower building unit for forming the concrete floor structure on the upper building unit thereto, said floor form panel having a hole;

an upright wall form assembly disposed above said floor form panel for forming a concrete wall structure on the concrete floor structure of the upper building unit;

a tapered positioning peg adapted to be embedded partially in the horizontal concrete floor structure, said positioning peg having an upper section projecting upwardly from said floor form panel supporting said upright wall form assembly, and a lower section passing movably through said hole and projecting downward from said floor form panel;

a strut adapted to be mounted on the lower building unit and including a top end connected to said lower section of said positioning peg, a bottom end, and a moving screw means attached to said bottom end for moving said strut upward.

2. The apparatus of claim 1, wherein said bottom end of said strut is hollow, said moving screw means including an internally threaded female member inserted fittingly into said bottom end, and a bolt extending threadedly through said female member, said bolt having a lower end projecting downward from said bottom end of said strut.

3. The apparatus of claim 1, further comprising an elongated guiding sleeve sleeved around said upper section of said positioning peg for embedment in the concrete floor structure of the upper building unit formed via said floor form panel, said upper section of said positioning peg having an upwardly converging outer surface, said guiding sleeve having an upwardly converging inner surface resting on said upwardly converging outer surface of said positioning peg, and an upwardly diverging outer surface.

4. The apparatus according to claim 3, further comprising a bracket adapted to be secured to the concrete wall structure of the lower building unit, said bracket having a horizontal plate portion with a hole, wherein said hole of said lower section of the corresponding one of said positioning pegs passes through above said strut.

* * * * *